US006010368A

United States Patent [19]

Tai

[11] Patent Number: 6,010,368

[45] Date of Patent: Jan. 4, 2000

[54] DUAL SLOT CARD EDGE CONNECTOR

[75] Inventor: Jeng-Wu Tai, Taipei, Taiwan

[73] Assignee: Hon Hai Precision Ind. Co., Ltd., Taipei Hsien, Taiwan

[21] Appl. No.: 09/348,717

[22] Filed: Jul. 6, 1999

[30] Foreign Application Priority Data

Dec. 24, 1998 [TW] Taiwan ..... 87221545

[51] Int. Cl.[7] ..... H01R 23/70

[52] U.S. Cl. ..... 439/637; 439/680

[58] Field of Search ..... 439/631, 633, 439/637, 636, 65, 61, 62, 680, 681

[56] References Cited

U.S. PATENT DOCUMENTS 4,990,097 2/1991 Billman et al. ..... 439/636
5,013,264 5/1991 Tondreault ..... 439/636
5,192,220 3/1993 Billman et al. ..... 439/637
5,403,208 4/1995 Felcman et al. ..... 439/633
5,931,701 8/1999 Pan et al. ..... 439/637

*Primary Examiner*—Gary F. Paumen
*Attorney, Agent, or Firm*—Wei Te Chung

[57] ABSTRACT

A card edge connector includes an insulative body defining two receiving slots therein for selectively receiving two daughter boards. The receiving slots are spaced from each other by an internal wall of the insulative body. Each receiving slot has a number of contact elements received and retained therein for electrically engaging with the corresponding daughter board. The daughter boards received in the receiving slots are disposed in opposite directions thereby eliminating the possibility of interference between electronic components mounted on the daughter boards.

2 Claims, 3 Drawing Sheets

DUAL SLOT CARD EDGE CONNECTOR

BACKGROUND OF THE INVENTION

1. Field of the Invention

The present invention generally relates to a card edge connector, and in particular to a card edge connector having two receiving slots for receiving two daughter boards.

2. The Prior Art

A card edge connector mounted on a mother board electrically connects a daughter board to the mother board. Conventionally, a card edge connector defines a single receiving slot for receiving one daughter board. A mother board may have a number of card edge connectors mounted thereon arranged substantially parallel to each other. The card edge connectors must be spaced from each other a predetermined distance for accommodating electronic components of the daughter boards.

FIG. 4 of the attached drawings shows an example of an arrangement of conventional card edge connectors 42 mounted on a mother board 44. Daughter boards 46 are received in the card edge connectors 42. Spaces are defined between the card edge connectors 42 for accommodating electronic components 48 mounted on the daughter boards 46. A disadvantage associated with such an arrangement is that a significant amount of space of the mother board 44 is needed to accommodate the daughter boards 46 thereby hindering miniaturization of the mother board 44.

It is thus desired to have a card edge connector which allows daughter boards to be compactly arranged on a mother board for space conservation purposes.

SUMMARY OF THE INVENTION

Accordingly, an object of the present invention is to provide a card edge connector for compactly arranging a plurality of daughter boards on a mother board.

Another object of the present invention is to provide a card edge connector defining two receiving slots therein for respectively receiving two daughter boards.

To achieve the above objects, a card edge connector in accordance with the present invention comprises an insulative body defining two receiving slots therein for selectively receiving two daughter boards. The receiving slots are spaced from each other by an internal wall of the insulative body. Each receiving slot has a number of contact elements received and retained therein for electrically engaging with the corresponding daughter board. The daughter boards received in the receiving slots are disposed in opposite directions thereby eliminating the possibility of interference between electronic components mounted on the daughter boards.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
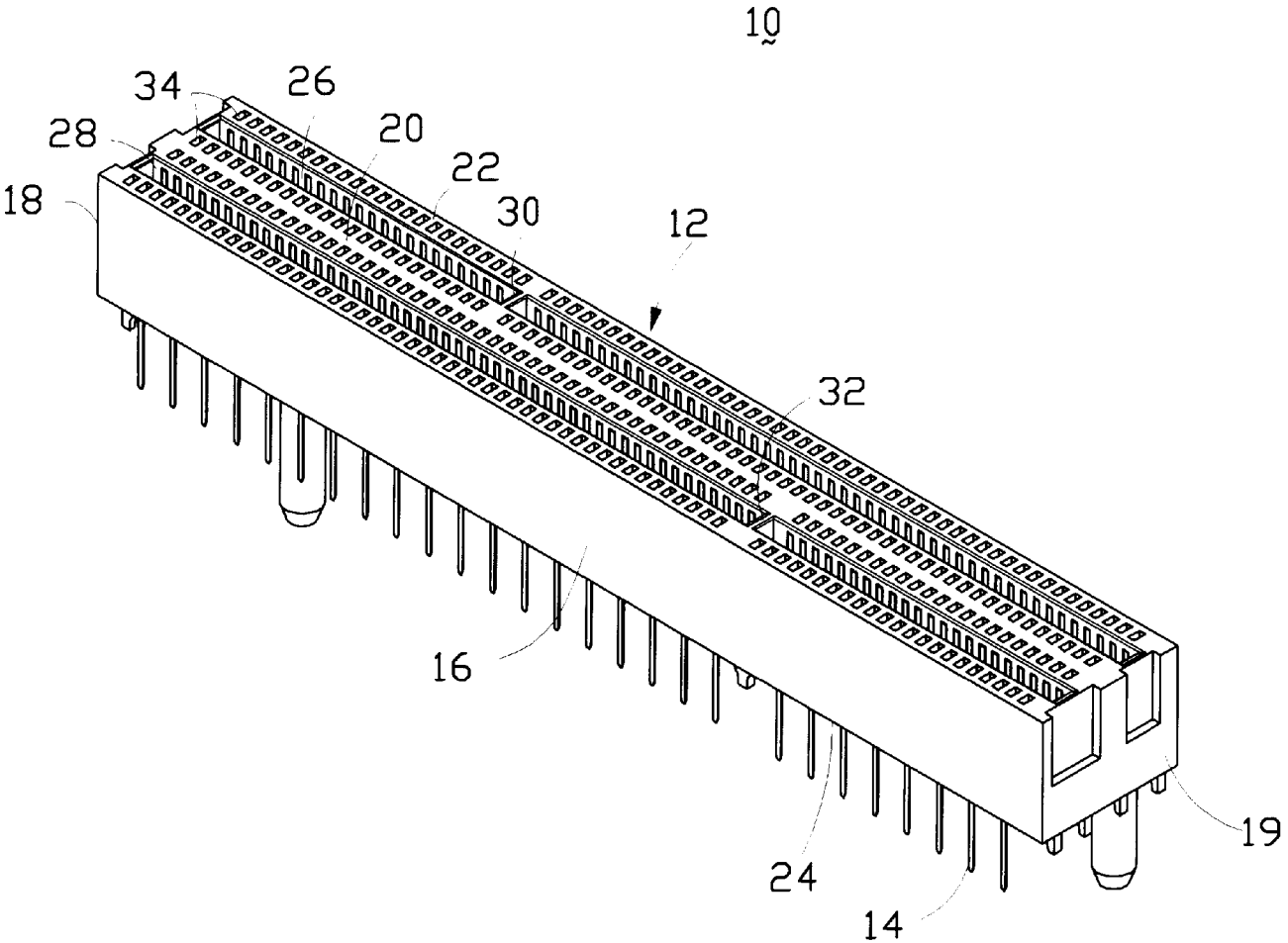
FIG. 1 is a perspective view of a card edge connector constructed in accordance with the present invention.
Figure 2:
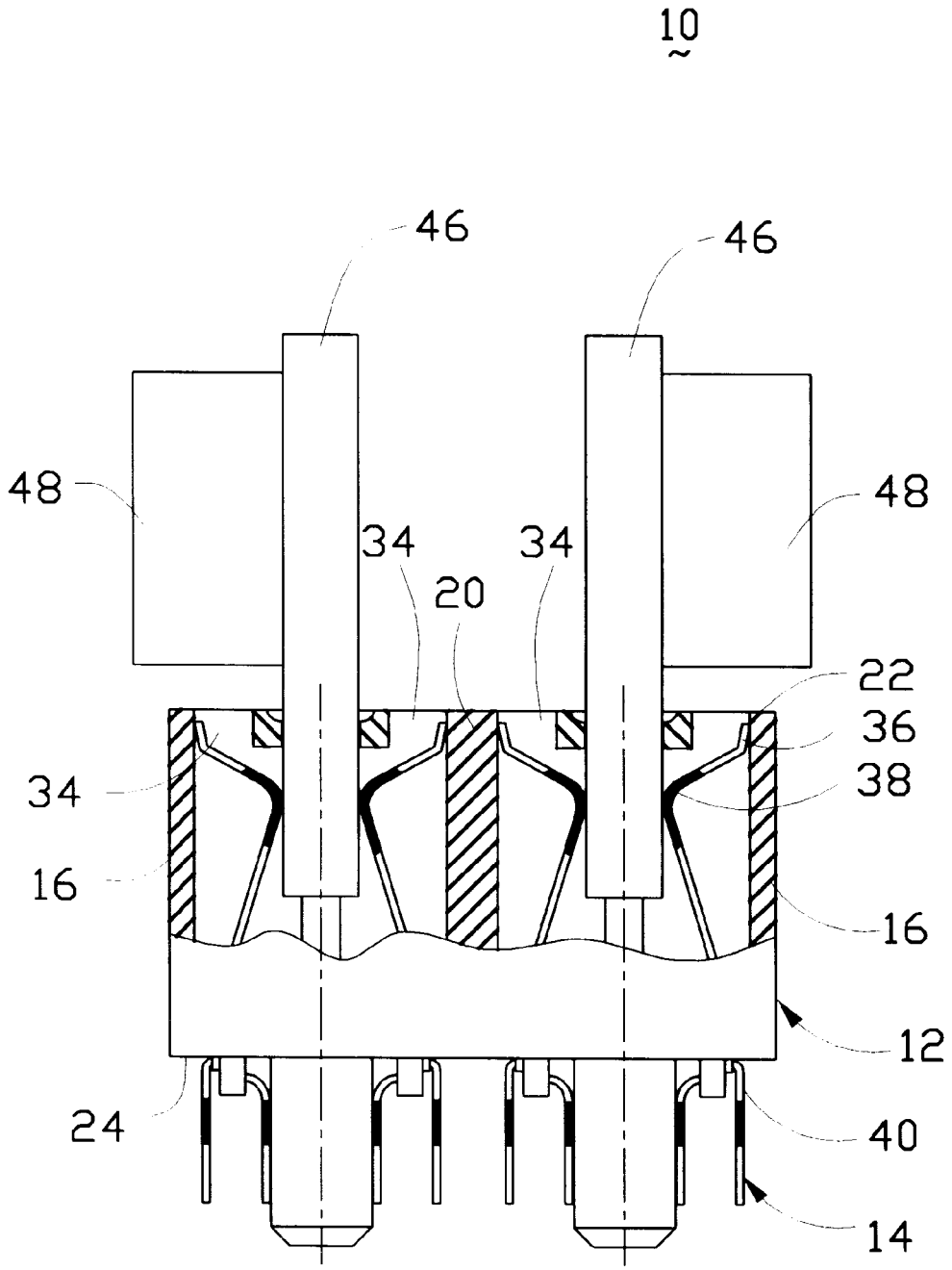
FIG. 2 is a cross-sectional view of the card edge connector of the present invention.
Figure 3:
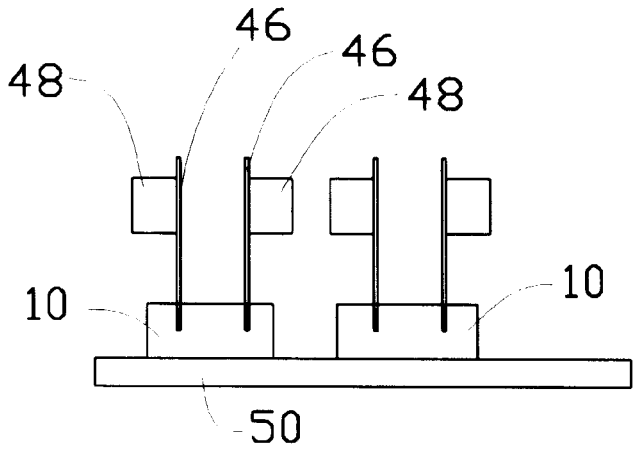
FIG. 3 is a schematic view showing a number of card edge connectors of the present invention mounted on a mother board for connecting a number of daughter boards thereto.

Referring to the drawings and in particular to FIGS. 1 and 2, a card edge connector 10 constructed in accordance with the present invention comprises an elongate insulative body 12 having a mating face 22 and a mounting face 24 for mounting on a mother board 50 (FIG. 3). The body 12 has two side walls 16 spaced from each other and connected at ends thereof by a first end wall 18 and a second end wall 19. An internal wall 20 is arranged between the side walls 16 and spaced therefrom to define first and second elongate receiving slots 26, 28 exposed to the mating face 22 for selectively receiving two daughter boards 46 therein.

Two rows of apertures 34 are defined in the mating face 22 at opposite sides of each receiving slot 26, 28 and in communication therewith for receiving contact elements 14 therein. Each contact element 14 has a mating section 38 located in the body 12 and engaging with a corresponding conductor (not shown) of the corresponding daughter board 46 and a tail section 40 extending beyond the mounting face 24 for being electrically connected to the mother board 50. The mating section 38 has an end 36 received and retained in the corresponding aperture 34.

The first and second receiving slots 26, 28 each have a key member 30, 32 formed therein. The key members 30, 32 are respectively located a predetermined distance from the first and second end walls 18, 19 whereby the daughter boards 46 received in the first and second slots 26, 28 are positioned in opposite directions, as shown in FIG. 2. Thus, the space between the two daughter boards 46 mounted in the card edge connector 10 is minimized without any mechanical interference occurring between electronic components 48 mounted thereon.

Figure 4:
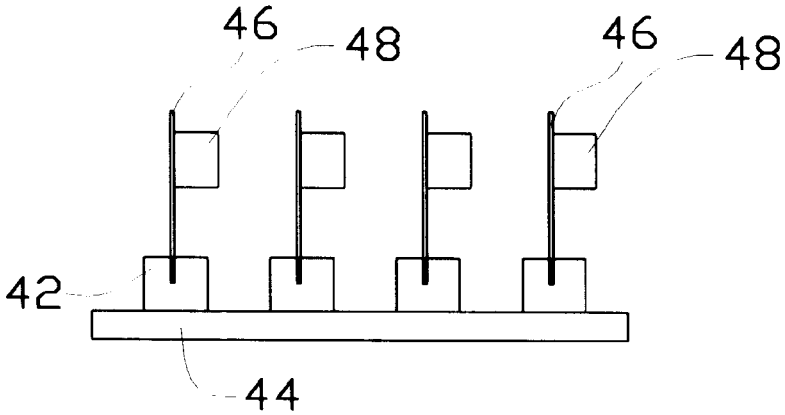
FIG.4 PRIOR ART
FIG. 4 is a schematic view showing a number of conventional card edge connectors mounted on a mother board for connecting daughter boards thereto.

In FIG. 3, two card edge connectors 10 of the present invention are mounted on the mother board 50 for connecting four daughter boards 46 thereto. Since the distance between the two daughter boards 46 received in the same card edge connector 10 is minimized, the occupied space on the mother board 50 is reduced. This is evident by comparing FIG. 3 with FIG. 4 which shows four conventional card edge connectors 42 mounted on a mother board 44 for connecting four daughter boards 46 thereto.

The feature of the invention is to provide a unitary housing to combine two card edge connectors together where the first and second receiving slots with respectively properly positioned key members may receive the corresponding daughter boards therein under the condition that the main surfaces of the daughter boards with main huge electronic components thereon, may face outward to an exterior where is vacant enough to have such components occupy thereof, and in opposite, the back surfaces of the daughter boards with minor or less/none components thereon, may face to each other with a relatively tiny space defined between the first and second receiving slots wherein such relatively tiny space saves space on the mother board while still keeps a sufficient distance between the two daughter boards, which are simultaneously received within the corresponding first and second receiving slots in the connector, for not interfering with each other.

Although the present invention has been described with reference to the preferred embodiment, it is apparent to those skilled in the art that a variety of modifications and changes may be made without departing from the scope of the present invention which is intended to be defined by the appended claims.

What is claimed is:

1. A card edge connector comprising an insulative body defining two receiving slots therein adapted to selectively receive two daughter boards, the receiving slots being spaced from each other by an internal wall of the insulative body, each receiving slot having a number of contact elements retained therein for electrically engaging with the corresponding daughter board;

wherein each receiving slot has a key member formed therein; and wherein the key member of the first receiving slot is located a predetermined distance from a first end of the insulative body and the key member of the second receiving slot is located the same distance from an opposite second end of the insulative body.

2. The card edge connector as claimed in claim 1, wherein the daughter boards are arranged in the receiving slots facing in opposite directions.

* * * * *